US005566810A

United States Patent [19]

Meyer et al.

[11] Patent Number: 5,566,810

[45] Date of Patent: Oct. 22, 1996

[54] REDUCTION OF HANDRAIL VIBRATION IN PASSENGER CONVEYORS

[75] Inventors: Helmut Meyer, Bueckeburg; Alfons von Herz, Stadthagen; Dirk Winkelhake, Buchholz, all of Germany

[73] Assignee: Otis Elevator Company, Farmington, Conn.

[21] Appl. No.: 501,346

[22] Filed: Jul. 12, 1995

[51] Int. Cl.[6] ..... B66B 23/06

[52] U.S. Cl. ..... 198/331; 198/335

[58] Field of Search ..... 198/330, 331, 198/335

[56] References Cited

U.S. PATENT DOCUMENTS

| | | | |
|---|---|---|---|
| 2,491,974 | 12/1949 | Hansen . | |
| 3,499,340 | 3/1970 | Teranishi et al. . | |
| 3,651,919 | 3/1972 | Vollmer | 198/331 |
| 3,658,166 | 4/1972 | Katsuta et al. . | |
| 3,696,909 | 10/1972 | Kojima et al. | 198/331 |
| 4,227,605 | 10/1980 | Hofling | 198/331 |
| 4,674,619 | 6/1987 | Nakazawa et al. | 198/331 |
| 4,775,044 | 10/1988 | Hofling | 198/331 X |
| 5,090,551 | 2/1992 | Yasuhara et al. | 198/331 X |
| 5,125,494 | 6/1992 | Nurnberg et al. | 198/331 |

FOREIGN PATENT DOCUMENTS

| | | | |
|---|---|---|---|
| 371716 | 5/1973 | U.S.S.R. | 198/331 |
| 1530558 | 12/1989 | U.S.S.R. . | |
| 2047646 | 12/1980 | United Kingdom | 198/331 |

*Primary Examiner*—D. Glenn Dayoan

[57] ABSTRACT

Movement of the handrail on an escalator or moving walkway passenger conveyor is smoothed out by providing a totally elastomeric coupling between the conveyor step chain and the handrail drive mechanism. The handrail drive mechanism is a friction drive roller, or belt, which is driven by being connected to the step chain. The connection between the step chain and the handrail drive is provided by an elastomeric member which engages both a step chain-driven sprocket and the handrail drive mechanism. The elastomeric connection damps out jerks which are created by the chordal nature of the step chain and the main motor drive chain as the chains pass around chain return sprockets. The elastomeric connection therefore smooths out movement of the handrail.

3 Claims, 3 Drawing Sheets

REDUCTION OF HANDRAIL VIBRATION IN PASSENGER CONVEYORS

TECHNICAL FIELD

This invention relates to a drive assembly for an escalator or moving walkway handrail which results in a smoothing of the movement of the handrail.

BACKGROUND ART

Modern-day escalators and moving walkway passenger conveyors are equipped with moving handrails which must be moved in synchronization with the conveyor treads upon which the passengers stand. The passenger treads are typically interconnected by step chains which are mounted about step chain sprockets. The step chain sprockets include a set of drive sprockets at one end of the conveyor and a pair of return sprockets at the opposite end of the conveyor. The step chain drive sprockets are connected to an electric drive motor by means of a drive chain. Thus, there are a plurality of chains that are employed to provide tread movement to the conveyor.

The handrail will typically be driven by means of a friction roll, or by a friction belt, which engages the handrail directly. The handrail drive will derive its motive power from the tread drive train, or directly from the main drive. Since the tread drive chain and the main drive both involve the use of several chains, passengers will be able to detect pulsations in the handrail's movement due to the chordal condition of the chains as they pass over the chain return sprockets. This problem has been recognized in the prior art, and a number of different solutions thereto have been suggested. U.S. Pat. Nos. 2,491,974 granted Dec. 20, 1949 and 3,499,340 granted Mar. 10, 1970, both describe a drive for a moving stairway wherein the drive sprocket includes elastomeric chain-engaging inserts on the sprocket for damping vibrations between the sprocket and chain during operation of the escalator. U.S. Pat. No. 3,658,166 granted Apr. 25, 1972 describes the use of an intermediate drive sprocket on a step chain, which intermediate sprocket engages the step chain at a location in between the chain reversal sprockets, and which intermediate sprocket is provided with involute teeth that mesh with the chain and are operable to smooth out movement of the step chain. Other efforts to smooth step chain movement have involved the use of enlarged diameter drive sprockets which, due to their enlarged diameters, reduce the size of each chordal step on the sprocket, and thus reduces the magnitude of chordal jerks imparted to the step chain by the drive sprocket.

Soviet Inventor's Certificate No. SU 1,530,558A1, published Dec. 23, 1989, describes an escalator handrail drive assembly which derives its motive power from the main escalator step chain drive. The handrail drive sprocket is connected to the step chain drive sprocket by means of a plurality of bolts which extend through shock absorbing elastomeric bushings so as to reduce the noise level of the escalator.

Recapping the aforesaid solutions to escalator chordally-induced jerks imparted to the handrail drive and the handrail, the use of damping inserts in the chain sprockets does not prevent sprocket teeth from jerking the chains. The use of enlarged drive sprockets has its limits due to available installation envelopes for the escalator drive mechanisms. The use of auxiliary drive sprockets in the step chain drive chain is expensive and space-consuming. Finally, the use of bolts and elastomeric bushings provides a degree of vibration damping, but the use of bolts provides a limiting factor which restricts the degree of damping for the handrail.

It would be highly desirable to provide a step chain drive to handrail drive connection which can completely damp out step chain jerks from being transmitted to the handrail drive so that handrail movement will be smooth and devoid of jerkiness.

DISCLOSURE OF THE INVENTION

This invention relates to a system for providing motive power to an escalator or moving walkway passenger conveyor handrail, which system delivers essentially jerk-free and smooth motion to the handrail while deriving motive power from the passenger conveyor step or tread chain. The conveyor treads are driven by an electric motor and an endless chain mounted about a motor drive sprocket and also mounted about a chain sprocket which is keyed to the tread step chain sprocket. The electric motor thus imparts rotational movement to the tread step chain drive sprocket which causes the step chain to move the step treads between the conveyor entrance and exit landings at a predetermined operating speed.

The step chain is connected by an idler sprocket to a handrail mover, which may be a drive roller, or an endless drive belt or the like, so that drive power is imparted to the handrail mover by the step chain. The connection between the step chain idler sprocket and the handrail mover is accomplished by means of an elastomeric connector which rotates as the step chain passes over the idler sprocket. The step chain thus transmits driving power to the handrail mover. The connector is preferably an elastomeric sleeve which engages the step chain idler sprocket on one end, and which engages the handrail mover on the other end. The elastomeric connector will transmit torque from the step chain idler sprocket to the handrail mover, and at the same time, will damp out any jerkiness emanating from the step chain. The elastomeric connector does not include any rigid components that extend from the step chain idler sprocket to the handrail mover, and thus no motion discontinuities emanating from the step chain or the drive chains can be transmitted to the handrail through the connector. The result is smooth, jerk-free movement of the handrail.

It is therefore an object of this invention to provide a passenger conveyor handrail drive assembly which imparts essentially smooth, jerk-free movement to the handrail.

It is an additional object of this invention to provide a handrail drive assembly of the character described wherein step and drive chain-induced jerks are not transmitted to the handrail.

It is a further object of this invention to provide a handrail drive assembly of the character described wherein motive power for the handrail is supplied via a totally elastomeric connector which contacts both a step chain-driven idler sprocket, and the handrail mover.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
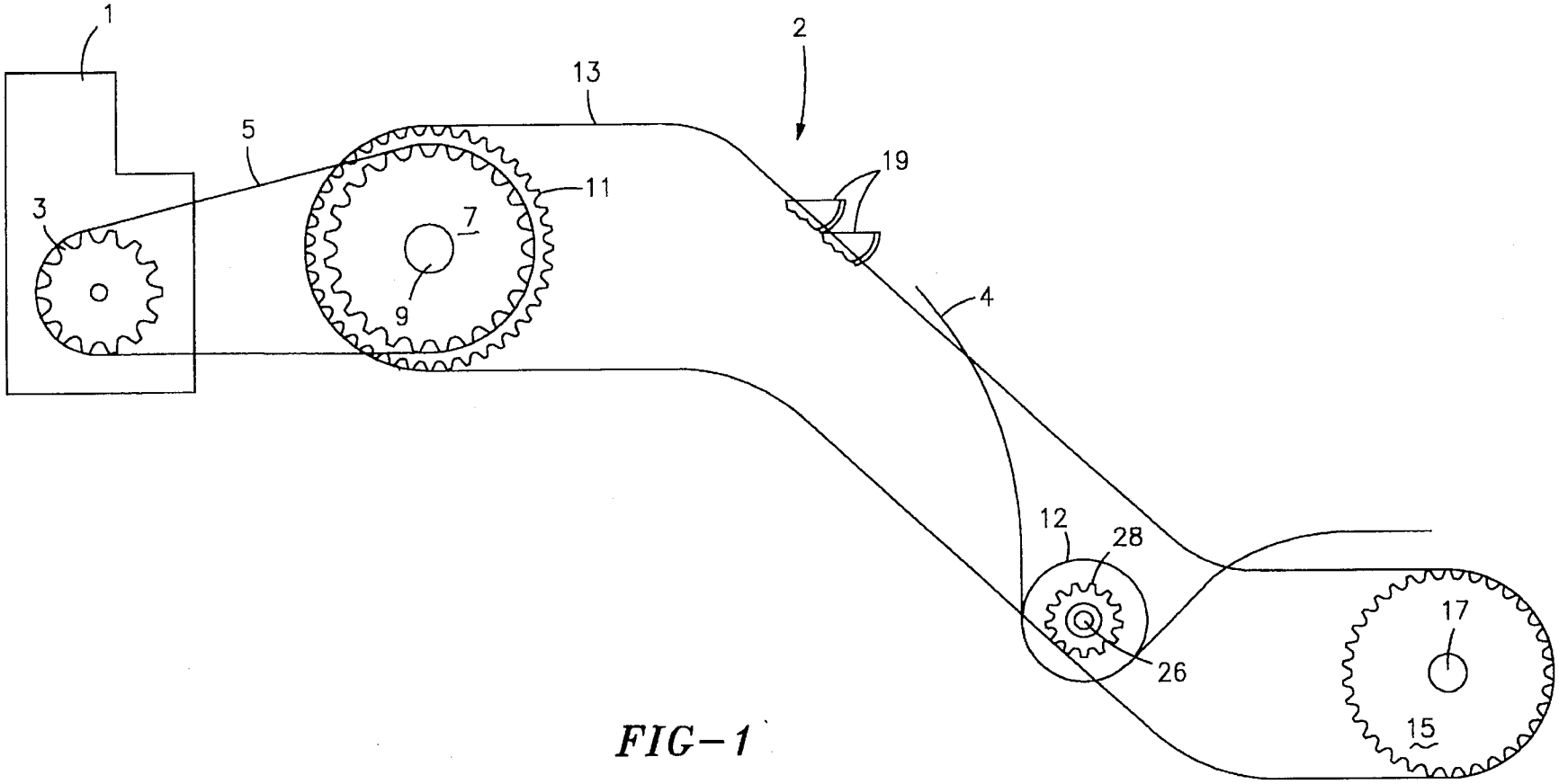
FIG. 1 is a schematic elevational view of a passenger conveyor escalator which is equipped with a handrail drive system formed in accordance with this invention.

Referring now to the drawings, there is shown in FIG. 1 a typical drive train for moving the steps (not shown) and the handrail 4 on an escalator 2. The escalator 2 includes an electric motor 1 from which it derives its motive power. The motor 1 includes a drive sprocket 3 about which a a drive chain 5 is mounted. The drive chain 5 is also connected to a power sprocket 7 which is keyed to a shaft 9 to which a step chain power sprocket 11 is also keyed. The step chain 13 is connected to steps or treads 19, and is mounted on the step chain power sprocket 11 and also on a return sprocket 15 which is rotatably mounted on a fixed shaft 17. The step chain 13 passes over an idler sprocket 28 which is rotatably mounted on a fixed shaft 26. The handrail friction drive roller 12 is also rotatably mounted on the fixed shaft 26.

Figure 2:
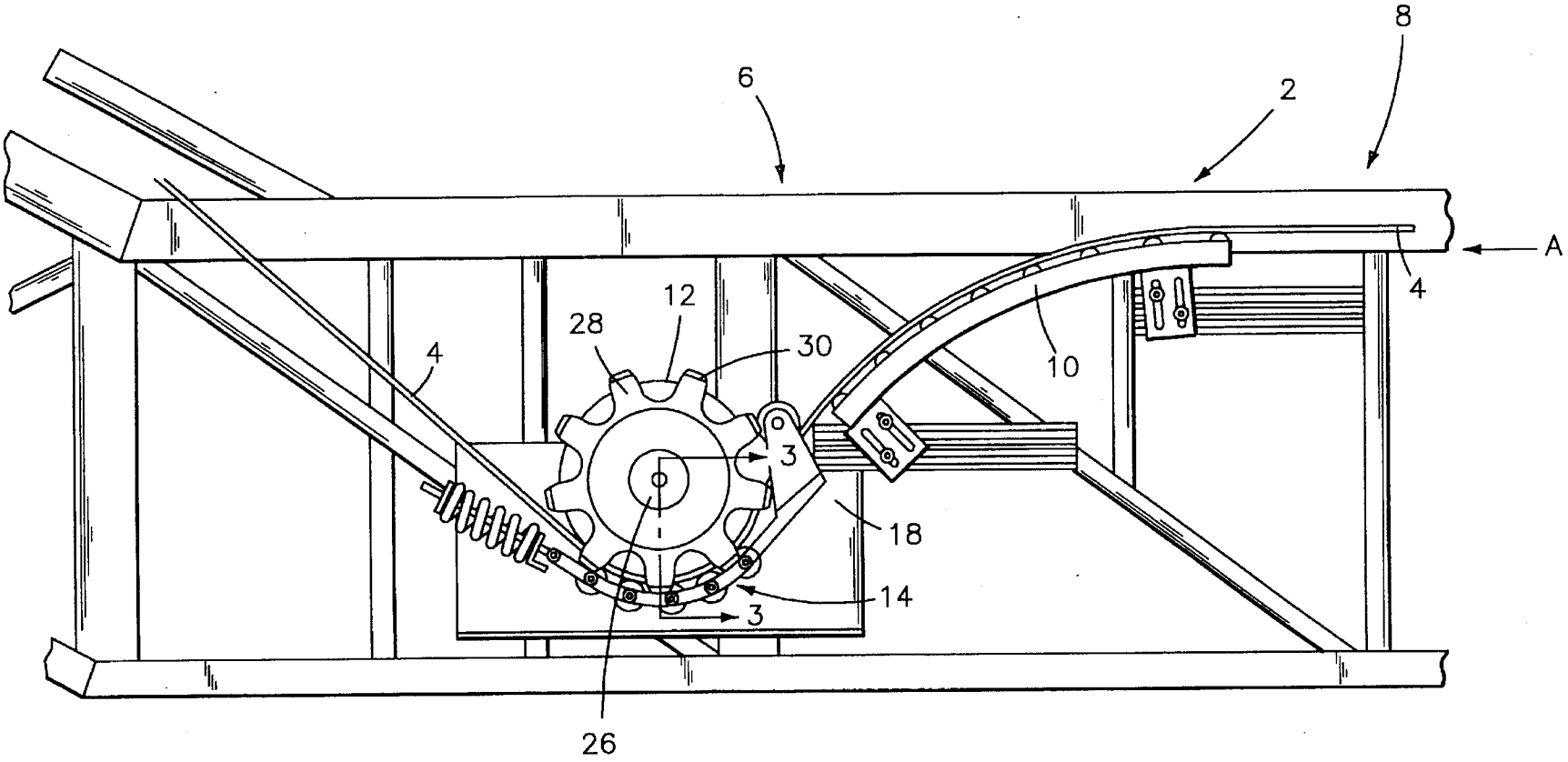
FIG. 2 is a more detailed side elevational view of the passenger conveyor handrail drive of FIG. 1.

Referring now to FIG. 2, the escalator truss is denoted generally by the numeral 6. The portion 8 of the escalator 2 shown in the drawing is a lower landing area, and the handrail 4 is moved in the direction of the arrow A. The handrail 4 passes over a bow 10 which imparts tension to the handrail 4; and thereafter, the handrail 4 passes around the friction drive roller 12. The handrail 4 is pressed against the drive roller 12 by means of a reaction roller train 14 which is mounted on a bracket 18 secured to the truss 6.

The idler sprocket 28 is is rotatably mounted on the fixed shaft 26. The step chain idler sprocket 28 includes circumferentially spaced teeth 30 that engage successive links on the step chain. The step chain idler sprocket 28 is preferably a pinwheel gear sprocket, and it is connected to, and supplies motive power to the handrail drive roller 12 in the manner described hereinafter.

Figure 3:
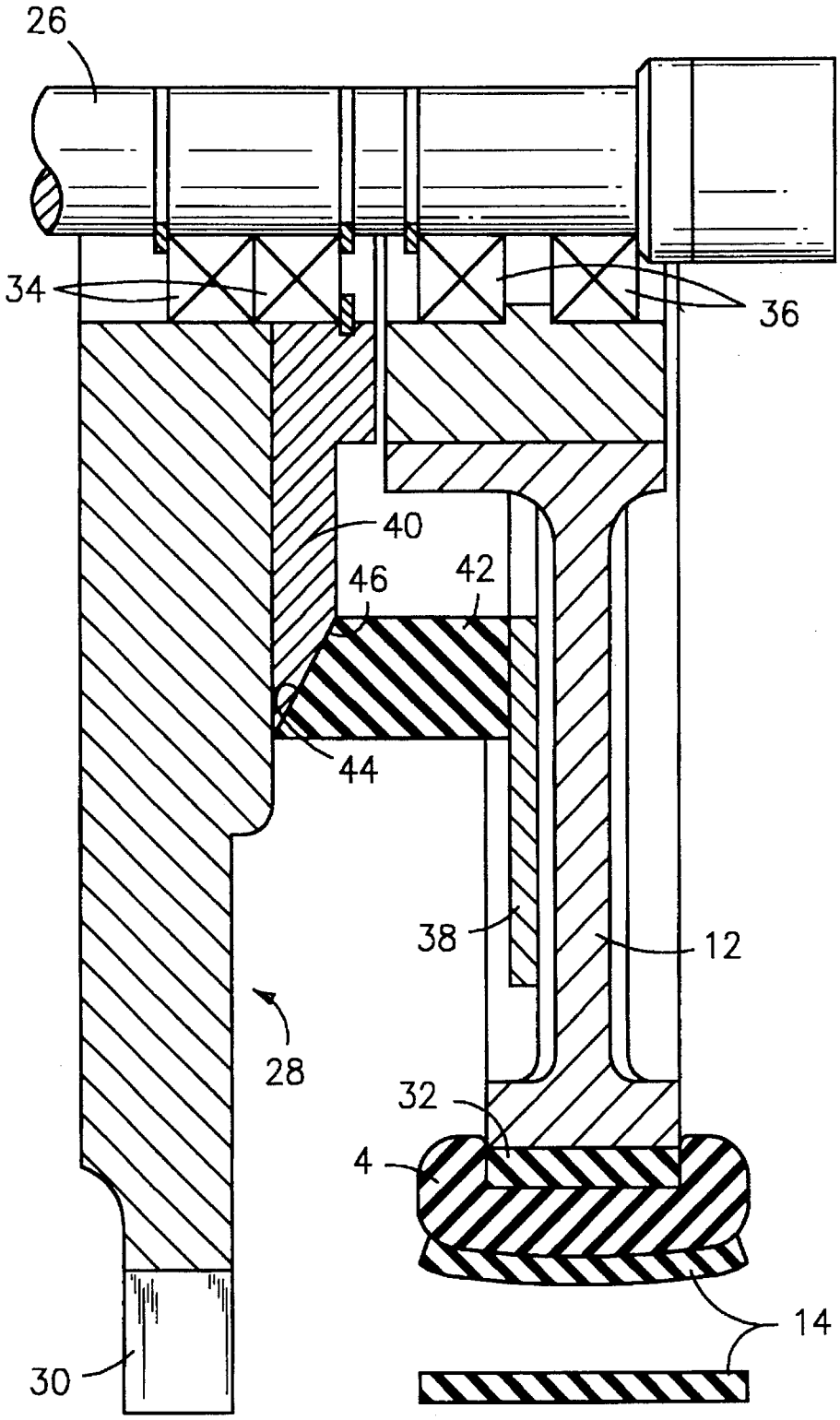
FIG. 3 is a sectional view taken along line 2—2 of FIG. 1 which shows specific details of the step chain-handrail drive connection formed in accordance with this invention.

Referring now to FIG. 3, details of the drive connection between the step chain idler sprocket 28 and the handrail drive roller 12 are shown. It will be noted that the handrail drive roller 12 includes an outer elastomeric sleeve 32 which contacts the handrail 4 to impart motive power thereto. The step chain idler sprocket 28 is mounted on the fixed shaft 26 by means of a first set of bearings 34; and the handrail drive roller 12 is mounted on the fixed shaft 26 by means of a second set of bearings 36. The two bearing sets 34 and 36 are spaced apart on the shaft 26, so that the step chain idler sprocket 28 and handrail drive roller 12 are independently rotatable on the shaft 26. The handrail drive roller 12 has a steel disc 38 affixed to the side thereof which faces the step chain idler sprocket 28, and the step chain sprocket 28 has a steel disc 40 affixed to the side thereof which faces the handrail drive roller 12. An annular elastomeric connector 42 is sandwiched between the discs 38 and 40, the connector 42 having a tapered end 44 surface which contacts a complementary tapered side surface 46 on the disc 40. The connector 42 is firmly bonded, such as by vulcanizing, onto the discs 38 and 40 so as to provide a resilient, torsionally flexible, functionally unitary, connection between the discs 38 and 40.

The connector 42 may be formed from natural rubber, synthetic rubber, polyurethane, or the like elastomers. The connector 42 provides the sole driving connection between the step chain idler sprocket 28 and the handrail drive roller 12. The handrail drive train thus has an internal vibration and noise-damping component which is completely elastomeric. The use of a completely elastomeric torsionally flexible drive coupling allows the drive train to be tuned to operating conditions. For example, in the case of passenger conveyors which experience higher magnitudes of vibration and noise, the drive connector 42 can be formed from a suitably stiff elastomer that will damp vibrations emanating from the drive chain and step chain from reaching the handrail drive roller 12. Likewise, smaller conveyors can be suitably tuned to essentially eliminate jerkiness in the handrail's motion.

It will be readily appreciated that the handrail drive train of this invention will provide for smoother handrail motion that will not be influenced by jerkiness emanating from the main drive or step chain chains. The use of a totally elastomeric drive connection which transmits rotational movement of the step chain to the handrail drive will prevent propagation of jerks to the handrail, which jerks are caused by the chordal configuration of the drive and step chains as they pass over the drive and step chain sprockets. It will be readily appreciated that a tensioned handrail drive belt could be used to drive the handrail instead of a handrail drive roller.

Since many changes and variations of the disclosed embodiment of the invention may be made without departing from the inventive concept, it is not intended to limit the invention otherwise than as required by the appended claims.

What is claimed is:

1. A handrail drive assembly in a passenger conveyor, which conveyor includes: a moving handrail; a drive motor; a drive motor chain; a plurality of passenger treads; tread chains attached to each of the passenger treads; and a plurality of drive sprockets and tread sprockets over which said drive motor chain and said tread drive chains, respectively, pass, said handrail drive assembly comprising:

a) rotatable handrail drive means engaging said handrail;

b) idler sprocket means engaging at least one of said tread chains whereby movement of said tread chains causes rotation of said idler sprocket means; and c) means for delivering power to the handrail drive means, said means for delivering power consisting essentially of an elastomeric coupling which engages both of said handrail drive means and said idler sprocket means, said elastomeric coupling being operable to damp motion jerks originating in said drive motor and/or tread drive chains so as to provide smoothed movement of said handrail.

2. The handrail drive assembly of claim 1 wherein said elastomeric coupling is an elastomeric sleeve which frictionally engages both of said handrail drive means and said idler sprocket means.

3. The handrail drive assembly of claim 2 wherein said elastomeric sleeve is bonded to both of said handrail drive means and said idler sprocket means.

* * * * *